United States Patent [19]

Gile et al.

[11] Patent Number: 4,628,643

[45] Date of Patent: Dec. 16, 1986

[54] GRINDING WHEEL INFEED CONTROL METHOD

[75] Inventors: Richard H. Gile, North Clarendon; Robert W. Ludwig, Perkinsville; Steven P. Farrar, Springfield; Steven P. Farmer, North Springfield; Eben C. Waterman, Springfield, all of Vt.

[73] Assignee: Ex-Cell-O Corporation, Troy, Mich.

[21] Appl. No.: 802,147

[22] Filed: Nov. 27, 1985

[51] Int. Cl.[4] ..... B24B 49/16

[52] U.S. Cl. ..... 51/325; 51/165.87; 51/165.93; 51/165.71

[58] Field of Search ..... 51/165 R, 165.77, 165.87, 51/165.93, 325, 165.92, 165.71

[56] References Cited

U.S. PATENT DOCUMENTS

| | | | |
|---|---|---|---|
| 3,344,560 | 10/1967 | Lillie | 51/165 R |
| 3,555,741 | 1/1971 | Hahn | 51/165 R |
| 3,983,376 | 9/1976 | Pozzetti | 51/165.77 |
| 4,071,980 | 2/1978 | Kebo | 51/165.87 |
| 4,139,969 | 2/1979 | Brown | 51/165.87 |
| 4,570,389 | 2/1986 | Leitch et al. | 51/325 |

*Primary Examiner*—Harold D. Whitehead

*Attorney, Agent, or Firm*—Edward J. Timmer

[57] ABSTRACT

The grinding wheel infeed control method provides a constant infeed rate calculated on the average electrical power consumed by the wheel drive motor in rough grinding an immediately preceding workpart. Each subsequent workpart is rough ground at a constant infeed rate established from the wheel drive motor power consumption of the immediately preceding workpart until the grinding wheel is in need of re-trueing or re-dressing. The first workpart ground after wheel re-trueing or re-dressing is ground at a rough (high) infeed rate which is continuously varied by the machine control computer so as to maintain the electrical power consumed by the grinding wheel drive motor substantially constant at a preset level and from which the constant infeed rate for the second workpart is determined.

9 Claims, 3 Drawing Figures

GRINDING WHEEL INFEED CONTROL METHOD

FIELD OF THE INVENTION

The invention relates to grinding methods with controlled infeed rate of the grinding wheel.

BACKGROUND OF THE INVENTION

During precision grinding operations using a superabrasive grinding wheel, it is necessary to adjust the grinding cycle of the grinding machine to accommodate gradual changes in the condition of the superabrasive wheel, such as increases in sharpness during a grinding run involving multiple workparts, from the time the wheel was last trued or dressed until the time it must be trued or dressed again. Typical superabrasive wheels are cubic boron nitride or diamond wheels.

In the past such changes in the condition of the grinding wheel have been accommodated by continuously monitoring the electrical power consumed by the grinding wheel drive motor, and inputting signals from a watts transducer used to monitor electrical drive motor power consumption into the microprocessor of the machine CNC control unit which continuously automatically controls and varies the wheel infeed rate so as to keep the wheel drive motor consumption essentially constant. However, in certain applications, continuous monitoring of motor power consumption and varying of wheel infeed rate has not provided acceptable infeed control, especially when an in-process size gage is employed during grinding or when the response speed of the control microcomputer is insufficient to achieve close stabilization of the grinding wheel drive motor power. With insufficient response speed, there tends to be a hunting action with the infeed control and typical overshoot and undershoot in infeed rate adjustment. In these situations, quality of the ground workpiece suffers.

U.S. Pat. No. 3,344,560 issued Oct. 3, 1967 illustrates control of the feed rate of a grinding wheel based on changes in deflection of the spindle carrying the wheel. U.S. Pat. No. 3,555,741 issued Jan. 19, 1971 discloses adjusting grinding force in response to signals from a proximity gage sensing spindle deflection resulting from changes in grinding force.

SUMMARY OF THE INVENTION

The present invention contemplates a method for grinding workparts in succession, especially using superabrasive grinding wheels, which method includes the steps of monitoring a first grinding parameter which depends on the condition of the grinding wheel, such as grinding wheel drive motor power consumption or grinding force changes, for each workpart and grinding the next successive workpart using a second grinding parameter, such as wheel infeed rate, determined from the monitored first grinding parameter of a preceding workpart. In this way, the method accommodates and adjusts for gradual changes in the condition of the grinding wheel.

The present invention also contemplates a grinding method involving the steps of monitoring electrical power drawn by the grinding wheel drive motor for a first workpart after trueing the wheel to desired dimension while controlling and varying the rough infeed rate so as to maintain the wheel drive motor power consumption substantially constant, then calculating the average electrical power level drawn or consumed for grinding the first workpart as well as average feed rate therefor, calculating a constant wheel infeed rate based on the average power level drawn and average feed rate and grinding the next workpart (second workpart) using the constant wheel infeed rate while monitoring electrical power drawn by the motor for the second workpart for recalculating a new average power level consumption from which a new constant infeed rate can be determined for the next following workpart (third workpart) to be ground. This sequence is repeated for each additional workpart until the wheel is in need of additional trueing or dressing. After wheel retruing, the above-described steps are repeated for still additional workparts.

Preferably, the grinding method described hereinabove is applied to the X-axis wheel infeed rate for the rough grinding portion of the grinding operation with a superabrasive wheel while the finish grinding portion is conducted in accordance with the prior art practice described hereinabove using a watts transducer or other power monitoring means with continuous monitoring and automatic CNC control of the finish infeed rate.

The steps of calculating the average electrical power drawn and the constant wheel infeed rate are preferably performed by the microprocessor of the machine control unit using appropriate algorithms stored in the microprocessor.

DESCRIPTION OF PREFERRED EMBODIMENTS

Figure 1:
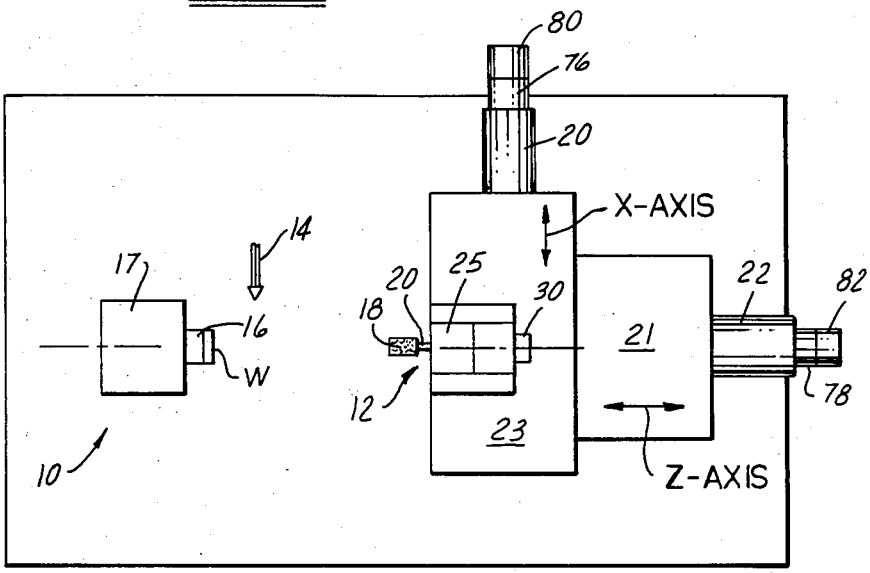
FIG. 1 is a schematic illustration of a grinding machine useful for practicing the method of the invention.

FIG. 1 illustrates schematically an internal grinding machine with a workhead 10, wheelhead 12 and wheel dresser 14 for use in practicing the method of the invention. The workhead 10, wheelhead 12 and dresser 14 are of conventioal construction, a grinding machine having such components being available under the trademark Lectraline grinding machine model LL 2-10 from Bryant Grinder Corporation, Springfield, Vt. 05156.

Figure 2:
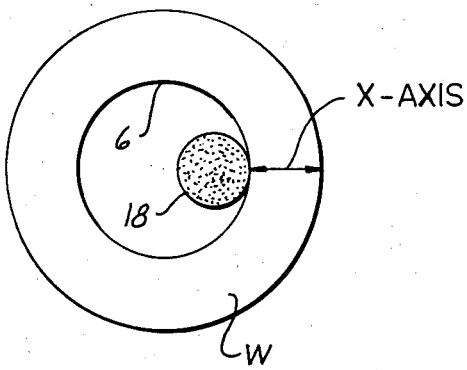
FIG. 2 is an enlarged view of the workpart and grinding wheel.

As is well known, the workpart W is chucked in the chuck 16 of the workhead and is rotated by the workhead spindle 17 during grinding but at a lesser speed of revolution than the grinding wheel 18 is rotated by spindle 20 of the wheelhead motor 25. The grinding wheel is of the superabrasive type; e.g. cubic boron nitride or diamond, and is reciprocated axially inside the bore of the chucked workpart while being radially fed or fed in the X-axis direction, FIG. 2, against the bore wall 6 in grinding relation at appropriate radial infeed rates for rough grinding and finish grinding described below. Reciprocating movement of the grinding wheel in the workpart bore is effected by a so-called Z-axis slide 21 which moves back and forth in the Z direction and radial infeeding of the wheel against the bore wall is effected by a so-called X-axis slide 23 moveable in the X-direction, all as is well known; for example, as shown in the Reda et al U.S. Pat. No. 4,419,612 issued Dec. 6, 1983, the teachings of which are incorporated herein by reference.

Internal grinding of bore wall 6 is effected in a successive rough grinding stage, rough spark-out, finish grinding stage, and finish spark-out stage. During rough grinding, the infeed rate of the grinding wheel against the bore wall is relatively high; e.g. 0.001 inch/second, while during finish grinding the radial infeed rate of the wheel is relatively low; e.g. 0.00025 inch/second. These infeed rates are of course provided by movement of the X-axis slide 23 under suitable servo loop control using a ball screw drive controlled by the CNC control unit 62 of the machine, FIG. 3; e.g. as described in the aformentioned Reda et al U.S. Pat. No. 4,419,612 and hereinafter. During rough or finish spark-out (also referred to in the art as dwell or tarry), the grinding wheel is maintained by the X-axis slide 23 in contact with the bore wall 6 with an essentially zero radial infeed rate of the wheel until grinding force decreases to or near the so-called threshold level below which no further grinding of the workpart occurs as is well known.

Figure 3:
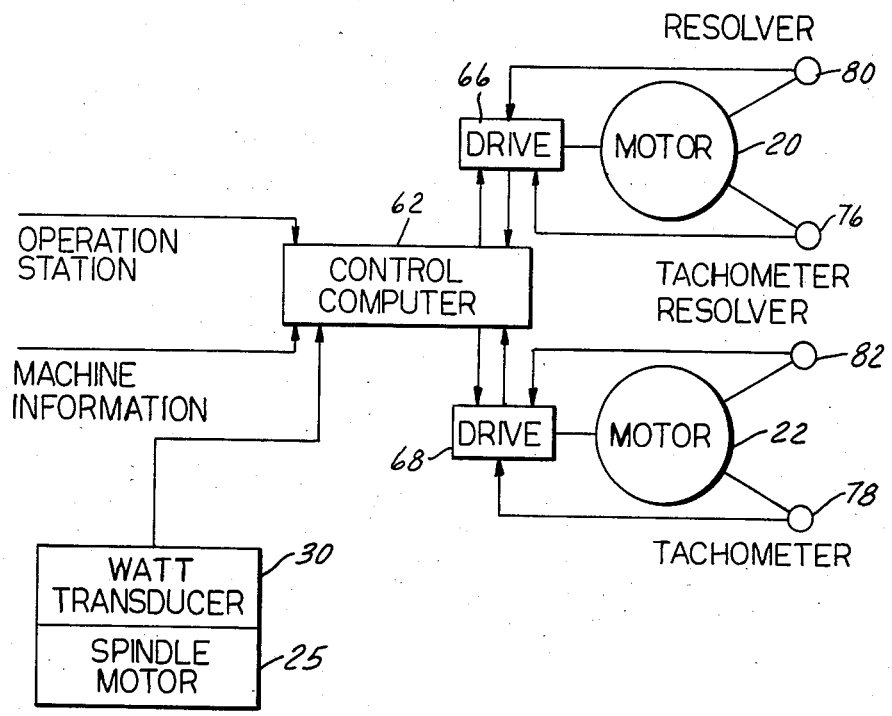
FIG. 3 is a block diagram of an exemplary machine control system for carrying out the method of the invention.

Referring to FIG. 3, there is provided a watts transducer 30 or other device functioning as a watt meter to monitor power consumption of spindle motor 25 during grinding and to provide in closed servo-loop manner signals representative of motor power consumption to a control computer 62 which is programmed to control all machine functions and interlocks which may include lubrication status, safety interlocks, motor watt consumption status and operation control station information. The watts transducer 30 is shown adjacent spindle motor 25 for convenience purposes; in practice, the watts transducer is located in a control cabinet adjacent the machine shown in FIG. 1. The control computer 62 may be any suitable digital computer or microprocessor. The control computer has stored the positions and rates for all the axis moves for the various operational sequences which may include a rough, finish and spark-out grind cycle, dress or wheel trueing cycle and so forth. The control computer sends servo-drive signals to the servo-drive means 66,68 for controlling the servo-motors 20,22 with respect to the X-axis and Z-axis slides to cause the grinding wheel to move. The servo-drive means 66,68 take feedback from the tachometers 76,78, respectively. The numerals 80,82 designate either resolvers, encoders or "INDUCTOSYN" transducers and they provide feedback signals to the drive means 66,68, respectively, in closed servo-loop manner with the tachometers.

A suitable control computer 62 is available from Intel Corp. of Santa Calar, Calif. 95054 and sold as an 86/05 Single Board Computer. The servo-drive means 66,68 may be any suitable servo-drive means as, for example, a SPR/X-1152 servo-drive available on the market from Inland Motor Division, Kollmorgen Corporation, 201 Rock Road, Radford, Va. 24141.

The servo-motors 20,22 may be any suitable D.C. or A.C. servo-motor. Suitable D.C. servo-motors are available from Torque Systems Inc., 225 Crescent Street, Waltham, MA 02154 under the trademark "SNAPPER". The tachometers 76,78 are part of the respective D.C. servo-motors. The resolvers, encoders of INDUCTOSYN transducers 80,82 are commercially available items and may be any suitable conventional position feedback devices on the market described in the aformentioned Reda et al U.S. Pat. No. 4,419,612. The Watts transducer 30 likewise is commercially available from A. F. Green Co., 15 Kelley Road, Salem, Mass. 01970.

In carrying out the invention, each workpart is subject to the rough grind, rough spark-out, finish grind and finish spark-out cycle with the radial infeed rate of the grinding wheel 18 controlled in a novel way for rough grinding. Wheel infeed rate control for the first workpart ground after wheel trueing or dressing and also for finish grinding all workparts is conducted in accordance with prior art practice of cntinuously monitoring power consumption of the wheel drive motor and automatically controlling the wheel infeed rate through control computer 62 so as to keep the grinding wheel drive motor power consumption substantially constant.

For rough grinding the first workpart, the grinding wheel 18 is first dressed or trued to proper dimension by dresser 40 which may be a rotary dresser or other known dresser construction. After chucking on the workhead spindle 17, the workpart is ground by reciprocating the freshly trued grinding wheel inside the workpart bore in the Z-direction and radially infeeding the wheel at a varying infeed rate (whose average is in the order of 0.001 inch/second) until the desired workpart bore ID (inner diameter) dimension is obtained during rough grinding. The watts transducer 30 inputs wheel drive motor power consumption signals to the control computer 62 which, in addition to varying the rough cycle infeed rate so as to maintain the power consumed by the wheel drive motor substantially at a selected constant level, also computes the average electrical power level drawn by drive motor 22 during the rough grind. During the rough grinding of said first workpart after wheel dressing or trueing, the computer also monitors the varying feed rate which it is causing, and calculates the average feed rate for use as Old F.R. as described below. Using the average electrical power level value and average feed rate value in conjunction with a suitable algorithm, the computer then calculates a constant or fixed radial wheel infeed rate to be used during the rough grind of the next workpart. Typical algorithms which the computer uses in the above calculation are as follows:

$$P_{average} - \frac{\sum_{1}^{n} P_n}{n} \tag{1}$$

where $P_n$ is a given power reading at each of the control computer scans; e.g., about 50 ms (millisecond) scans; where n is the number of power readings taken during the rough grind part of the cycle. This number varies depending on the grind time.

where $P_{average}$=average power used by the wheelhead in a given rough grind cycle and $$\Delta P = \frac{P_{set} - P_{average}}{P_{average}} \tag{2}$$

where $P_{set}$ is the desired grind power level as set by the operator.

where $\Delta P$ is the error in power level of grind from desired level measured in percentage and $$\text{New } F.R. = \text{Old } F.R. + \Delta P\,(\text{Old } F.R.) \tag{3}$$

wherein New F.R.=New constant feed rate to be used on the next workpart.

where Old F.R. = Feed rate used on the last previous workpart when the power readings were sampled, which for the first workpart after retrueing is the average of the varying feed rate but for subsequent workparts is simply different constant feed rates.

The calculated constant radial wheel infeed rate based on the average power level during rough grinding the first workpart is stored in the memory of the control computer.

$$\text{Of course, } F.R. \text{ average} = \frac{\sum_{1}^{n} F.R.}{n}$$

when n is the number of feed rate readings (F.R.) taken or sampled during the rough grind part of the cycle.

The first workpart is then subjected to the finish grind and spark-out portions of the grinding cycle in accordance with known practice.

Following grinding of the initial or first workpart, the next (second) workpart is subsequently ground with the radial wheel infeed rate during rough grinding controlled at a constant rate equal to that calculated by the computer and stored in memory i.e. the constant infeed rate calculated using the average drive motor power level which existed during rough grinding of preceding workpart as well as preceding constant feed rate value in conjunction with the aformentioned algorithms. Power consumption of drive motor 25 changes during grinding of the second workpart and is monitored by the watts transducer 30 for input to computer 62. Rough grinding and rough spark-out are continued until an in-process workpart gage indicates that the desired rough ground bore ID (inner diameter) has been obtained. Then, the bore is finish ground to spark-out in accordance with the usual practice.

Grinding of each additional third, fourth, fifth, etc. workpart is continued by calculating a new constant rough grinding wheel infeed rate for the next workpart on the basis of the average power drawn by the grinding wheel drive motor 25 from the monitored power consumption during the rough grinding of the immediately preceding workpart until the grinding wheel 18 requires re-trueing or re-dressing to return it to desired dimension. Then, the method described above is repeated for still other workparts and so on until the wheel requires re-trueing.

The control of radial wheel infeed rate in the above manner during the rough grinding cycle of the grinding operation for each workpart provides a higher quality ground workpart by providing better geometry, such as roundness and straightness, of the workpart bore as a result from accommodating gradual changes in the grinding wheel over time of a grinding run involving grinding of multiple workparts.

Although the inventive method has been described hereinabove with respect to the rough grinding cycle of the grinding operation, it may also have applicability for the finish grind cycle as well, although the rate of radial wheel infeed during finish grind is so small that obtaining the desired workpart geometry is more satisfactorily achieved with the control computer 62 and conventional in-process gaging.

Furthermore, instead of monitoring electrical power drawn by the grinding wheel drive motor 25 to provide a first monitored grinding parameter, those skilled in the art will appreciate that other grinding parameters may be monitored such as deflection of wheelhead spindle 20 or changes in grinding force as taught for example in the aforementioned U.S. Pat. Nos. 3,344,560 and 3,555,741, the teachings of which are incorporated herein by reference.

Although certain preferred features and embodiments of the invention have been described hereinabove and illustrated in the Figures, it is to be understood that modifications and changes may be made therein without departing from the spirit and scope of the invention as defined in the appended claims.

We claim:

1. A method for grinding workparts in succession while accommodating progressive change in wheel sharpness comprising monitoring a first grinding parameter and calculating an average value of the first grinding parameter for each workpart in succession as sharpness of the grinding wheel progressively changes, and grinding the next successive workpart using a second grinding parameter determined from the calculated average of the monitored first grinding parameter of a preceding workpart.

2. The method of claim 1 wherein the second grinding parameter is maintained substantially constant during grinding of said next successive workpart.

3. A method for grinding workparts in succession while accommodating progressive change in grinding wheel sharpness comprising, (1) monitoring a first grinding parameter during grinding of a first workpart, while a second grinding parameter is varied to maintain the first parameter substantially constant, (2) determining a desired value for the second grinding parameter based on an average value of the monitored grinding parameter for the first workpart and storing the desired value in memory means, (3) grinding a second workpart using the desired value for the second grinding parameter while monitoring the first grinding parameter and calculating and storing in memory means another average value for the first grinding parameter for the second workpart for use in determining another desired value for said second grinding parameter for grinding the next workpart and repeating step (3) for each successive workpart to be ground next as sharpness of the grinding wheel progressively changes.

4. A method for grinding while accommodating a progressive change in grinding wheel sharpness comprising, (1) monitoring electrical power consumed by a grinding wheel drive motor during grinding with a trued grinding wheel of a first workpart at an infeed rate between the grinding wheel and workpart varied so as to maintain said power substantially constant at a desired level, (2) calculating an average power consumption value and an average infeed rate for grinding the first workpart, (3) calculating a desired constant infeed rate for the grinding wheel using the average power consumption value and average infeed rate, and grinding the second workpart using the desired constant infeed rate while monitoring said drive motor power consumed for the second workpart and calculating another average power consumption value for said second workpart, and calculating a new desired constant infeed rate for grinding the next workpart based on said another average power consumption value and repeating step (3) for each successive workpart to be ground as sharpness of the grinding wheel changes until the wheel is retrued or dressed.

5. The method of claim 4 which further includes a final step of retruing or dressing the grinding wheel and then repeating the steps (1)–(3) set forth in claim 4 for additional workparts.

6. The method of claim 4 which comprises rough grinding the first workpart and additional workparts using the steps (1)–(3).

7. The method of claim 6 which comprises rough grinding the internal cyclidrical bore of the first workpart and additional workparts.

8. The method of claim 4 wherein the steps of calculating the average power level, average infeed rate, and desired infeed rate are performed by a microprocessor of a grinding machine CNC control unit.

9. The method of claim 4 using a superabrasive grinding wheel.

* * * * *